US008713982B2

(12) United States Patent
Stranz et al.

(10) Patent No.: US 8,713,982 B2
(45) Date of Patent: May 6, 2014

(54) DEVICE FOR EXPLOSIVE FORMING

(75) Inventors: Andreas Stranz, Reichenau (AT); Alexander Zak, Moedling (AT)

(73) Assignee: Magna International Inc., Aurora (CA)

( * ) Notice: Subject to any disclaimer, the term of this patent is extended or adjusted under 35 U.S.C. 154(b) by 334 days.

(21) Appl. No.: 12/865,266

(22) PCT Filed: Sep. 19, 2008

(86) PCT No.: PCT/EP2008/007901

§ 371 (c)(1),
(2), (4) Date: Jul. 29, 2010

(87) PCT Pub. No.: WO2009/095042

PCT Pub. Date: Aug. 6, 2009

(65) Prior Publication Data

US 2010/0326158 A1 Dec. 30, 2010

(30) Foreign Application Priority Data

Jan. 31, 2008 (DE) ..... 10 2008 006 979

(51) Int. Cl.
*B21D 26/02* (2011.01)

(52) U.S. Cl.
USPC ..... 72/56; 72/54; 72/61; 72/62; 72/430; 72/706; 29/421.1; 29/421.2; 148/515; 228/107

(58) Field of Classification Search
USPC ..... 72/54, 56, 61, 62, 430, 706; 102/305, 102/309, 331, 475; 29/421.1, 421.2; 148/515; 228/107
See application file for complete search history.

(56) References Cited

U.S. PATENT DOCUMENTS

| | | | |
|---|---|---|---|
| 392,635 | A | 11/1888 | Powers |
| 3,160,949 | A | 12/1964 | Bussey et al. |
| 3,162,087 | A | 12/1964 | Lakes |
| 3,252,312 | A | 5/1966 | C.E. Maier |
| 3,342,048 | A | 9/1967 | Johnson et al. |
| 3,561,239 | A | 2/1971 | Tominaga et al. |
| 3,600,921 | A | 8/1971 | Schwarz |
| 3,640,110 | A | 2/1972 | Inoue |
| 3,654,788 | A | 4/1972 | Kimura |
| 3,661,004 | A | 5/1972 | Lee et al. |
| 1,280,451 | A | 7/1972 | Hagen |
| 3,737,975 | A | 6/1973 | McKinnon, Jr. |

(Continued)

FOREIGN PATENT DOCUMENTS

| | | |
|---|---|---|
| AT | 248838 | 8/1966 |
| AT | 276032 | 11/1969 |

(Continued)

OTHER PUBLICATIONS

CN 200880126045.6, OA Apr. 19, 2013 (translation).

*Primary Examiner* — Shelley Self
*Assistant Examiner* — Onekki Jolly
(74) *Attorney, Agent, or Firm* — Millman IP Inc.

(57) ABSTRACT

The invention relates to a device for explosive forming of workpieces, comprising an ignition chamber and an ignition mechanism, wherein an explosive agent can be ignited at an ignition location in the ignition chamber using the ignition mechanism, and an ignition chamber outlet is provided, to be improved such that the ignition mechanism has a longer service life. The aim is achieved by a device wherein an impact breaker is provided in the propagation path (37) of the detonation wave.

43 Claims, 8 Drawing Sheets

(56) References Cited

U.S. PATENT DOCUMENTS

| | | | | |
|---|---|---|---|---|
| 3,742,746 | A | 7/1973 | Erlandson | |
| 4,187,709 | A | 2/1980 | Legate et al. | |
| 4,471,640 | A | 9/1984 | Kortenski et al. | |
| 4,492,104 | A | 1/1985 | Weaver et al. | |
| 4,494,392 | A * | 1/1985 | Schroeder | 72/56 |
| 4,571,800 | A | 2/1986 | Faupell | |
| 4,738,012 | A | 4/1988 | Hughes et al. | |
| 4,788,841 | A | 12/1988 | Calhoun et al. | |
| 4,856,311 | A * | 8/1989 | Conaway | 72/56 |
| 4,925,499 | A * | 5/1990 | Wohr | 148/195 |
| 5,187,962 | A | 2/1993 | Bilko et al. | |
| 5,220,727 | A | 6/1993 | Hochstein | |
| 5,339,666 | A * | 8/1994 | Suzuki et al. | 72/56 |
| 5,377,594 | A * | 1/1995 | Alford | 102/308 |
| 5,890,698 | A | 4/1999 | Domytrak | |
| 2006/0060601 | A1 | 3/2006 | Kubacki et al. | |
| 2009/0205396 | A1 * | 8/2009 | Zak et al. | 72/430 |

FOREIGN PATENT DOCUMENTS

| | | | | |
|---|---|---|---|---|
| AT | 371384 | | 6/1983 | |
| CH | 409831 | | 10/1966 | |
| DE | 1452667 | U | 12/1938 | |
| DE | 1218986 | | 1/1967 | |
| DE | 1235246 | B1 | 3/1967 | |
| DE | 1129562 | | 10/1968 | |
| DE | 1452665 | A1 | 5/1969 | |
| DE | 1452667 | A1 | 5/1969 | |
| DE | 1527949 | A1 | 11/1969 | |
| DE | 1801784 | A1 | 6/1970 | |
| DE | 1808942 | A1 | 6/1970 | |
| DE | 2043251 | | 9/1970 | |
| DE | 1777207 | A1 | 4/1971 | |
| DE | 1777208 | A1 | 4/1971 | |
| DE | 2043251 | | 3/1972 | |
| DE | 2059181 | A1 | 6/1972 | |
| DE | 2107460 | A1 | 8/1972 | |
| DE | 2357295 | A1 | 5/1974 | |
| DE | 2337176 | A1 | 6/1975 | |
| DE | 114231 | | 7/1975 | |
| DE | 2622317 | A1 | 1/1977 | |
| DE | 2628579 | A1 | 12/1977 | |
| DE | 2908561 | A1 | 10/1979 | |
| DE | 158364 | | 12/1983 | |
| DE | 3341488 | A1 | 5/1984 | |
| DE | 3305615 | A1 | 8/1984 | |
| DE | DD217154 | A1 | 1/1985 | |
| DE | 3590248 | C2 | 6/1986 | |
| DE | 3512015 | A1 | 10/1986 | |
| DE | 3709181 | A1 | 9/1988 | |
| DE | DD260450 | A1 | 9/1988 | |
| DE | 4035894 | C1 | 1/1992 | |
| DE | 4232913 | C2 | 4/1994 | |
| DE | 19536292 | | 4/1997 | |
| DE | 19638679 | A1 | 3/1998 | |
| DE | 19638688 | A1 | 3/1998 | |
| DE | 19709918 | A1 | 9/1998 | |
| DE | 19818572 | C1 | 11/1999 | |
| DE | 19852302 | A1 | 5/2000 | |
| DE | 19915383 | B4 | 10/2000 | |
| DE | 19957836 | A1 | 6/2001 | |
| DE | 10328154 | A1 | 12/2004 | |
| DE | 102005025660 | A1 | 12/2006 | |
| DE | 102006056788 | | 12/2006 | |
| DE | 102007007330 | | 2/2007 | |
| DE | 102007023669 | | 5/2007 | |
| DE | 102006008533 | A1 | 8/2007 | |
| DE | 102007036196 | | 8/2007 | |
| DE | 102006019856 | A1 | 11/2007 | |
| DE | 102006037754 | B3 | 1/2008 | |
| DE | 102008006979 | | 1/2008 | |
| DE | 102006037742 | A1 | 2/2008 | |
| DE | 102006060372 | A1 | 6/2008 | |
| EP | 0151490 | A2 | 8/1985 | |
| EP | 148459 | B1 | 11/1987 | |
| EP | 0288705 | A2 | 11/1988 | |
| EP | 00371018 | B1 | 7/1992 | |
| EP | 0592068 | A1 | 4/1994 | |
| EP | 0590262 | B1 | 4/1996 | |
| EP | 0765675 | A2 | 4/1997 | |
| EP | 0830906 | A1 | 3/1998 | |
| EP | 0830907 | A * | 3/1998 | B21D 26/08 |
| EP | 0830907 | A2 | 3/1998 | |
| EP | 1702695 | A2 | 9/2006 | |
| EP | 1849551 | A2 | 10/2007 | |
| FR | 1342377 | A | 9/1963 | |
| FR | 2300322 | A1 | 2/1975 | |
| FR | 2280465 | | 2/1976 | |
| FR | 7503396 | | 9/1976 | |
| GB | 742460 | | 6/1952 | |
| GB | 878178 | A * | 9/1961 | |
| GB | 1280451 | A * | 2/1968 | B23P 3/09 |
| GB | 1129562 | A | 10/1968 | |
| GB | 1280451 | A | 7/1972 | |
| GB | 1419889 | | 12/1975 | |
| GB | 1436538 | | 5/1976 | |
| GB | 1501049 | A * | 2/1978 | B21D 26/12 |
| GB | 1542519 | A | 3/1979 | |
| GB | 2009651 | A | 6/1979 | |
| GB | 2047147 | A | 11/1980 | |
| JP | 55-139128 | A | 10/1980 | |
| JP | 58145381 | A | 8/1983 | |
| JP | 2117728 | A | 5/1990 | |
| JP | 739958 | | 2/1995 | |
| JP | 07051761 | * | 2/1995 | B21D 26/08 |
| JP | 70505176 | | 2/1995 | |
| JP | 7-88570 | A | 4/1995 | |
| JP | 2001054866 | A | 2/2001 | |
| JP | 2002093379 | A | 3/2002 | |
| JP | 2007-222778 | A | 9/2007 | |
| WO | 9508410 | A | 3/1995 | |
| WO | 9933590 | A2 | 7/1999 | |
| WO | 0000309 | A1 | 1/2000 | |
| WO | 2004028719 | A1 | 4/2004 | |
| WO | 2006/128519 | A1 | 4/2006 | |
| WO | 2006128519 | A | 12/2006 | |
| WO | 2008098608 | A1 | 8/2008 | |
| WO | 2009095042 | A1 | 8/2009 | |

* cited by examiner

DEVICE FOR EXPLOSIVE FORMING

CROSS-REFERENCE TO RELATED APPLICATIONS

This application is a National Entry Application of PCT/EP08/007,901, filed Sep. 19, 2008, which claims priority from German Patent Application Serial No. 102008006979.5, filed on Jan. 31, 2008, entitled "Vorrichtung für das Explosionsumformen" (Device For Explosive Forming), the disclosures of which are incorporated herein by reference for all purposes.

FIELD OF THE INVENTION

The invention relates to a device for explosive forming.

BACKGROUND OF THE INVENTION

A device of the above-mentioned class is described in WO 2006/128519. An ignition tube connects a detonation chamber inside a work piece with a gas supply, exhaust, and ignition device, wherein the ignition device is integrated in the ignition tube. The gas, oxyhydrogen in stoichiometric mixture with low oxygen excess, is ignited by the ignition tube arranged in the ignition device. The explosion of the gas develops a detonation wave, which forms the work piece and then wanes.

Experience with similar devices has shown that the ignition device and/or the ignition mechanism get damaged by the explosive forming.

SUMMARY OF THE INVENTION

It is therefore the object of the invention to improve a device of the previously-mentioned class such that a good detonation wave can develop, that the explosion procedure can progress in a more orderly manner, and that the ignition mechanism has a longer service life.

This objective is met by a device having the characteristics of claim 1 in accordance with the invention.

The wave breaker provided in the propagation path of the detonation wave reduces the energy of the detonation wave, which allows the device to be protected from high mechanical stress, and thus also from permanent damage. Surprisingly, the heavy reduction of the reflected shock wave already results in an extension of the service life of the ignition mechanism.

In a variation of the invention, the wave breaker can be arranged between the ignition location and the ignition chamber outlet. Thus, the detonation wave returning through the ignition chamber outlet can be diminished in its energy. The explosion propagating from the ignition location can sufficiently develop to form the work piece while passing through the forming tool, despite the wave breaker.

In a beneficial exemplary embodiment of the invention, the wave breaker can be arranged in closer proximity to the ignition location than to the ignition chamber outlet. This has the advantage that after passing through the wave breaker, an adequate stretch through the ignition chamber remains for the developing detonation wave to unfold, whereas the energy of the reflected detonation wave is diminished when reaching the wave breaker.

Advantageously, the wave breaker can be arranged directly at the ignition location. In this way, the ignition device can still be effectively protected against the reflected detonation wave. Nonetheless, the explosion can still be ignited there, and can propagate from there.

In a preferred embodiment of the invention, the wave breaker can be arranged on the side of the forming tool facing away from the ignition location. After passing through the forming tool, the energy of the detonation wave is dampened by the wave breaker. In this way, the well-developed explosion energy can be contained in the detonation wave until the detonation wave reaches the forming tool.

In a particular way, the wave breaker can also be arranged directly on the side of the forming tool facing away from the ignition location. The energy of the detonation wave passing through the forming tool can thus be dampened immediately after passing through the forming tool.

Advantageously, the wave breaker can be arranged closer to the end of the device located opposite the ignition location. The counter-effect on the forming tool from the detonation wave impacting the wave breaker could be diminished in this way.

It can also be conceivable that the wave breaker forms the end of the device located opposite the ignition location. The wave breaker could thus have the effect of a scattering element, which is impacted by the detonation wave.

It is suggested that the wave breaker can be arranged inside a support pipe, which can be mounted on the forming tool on the side of the forming tool facing away from the ignition location. The material of the support pipe could be different from that of the wave breaker and could simplify the construction of the wave breaker by being an insert.

Advantageously, the wave breaker and the support pipe in combination can be designed as an end piece. This end piece could connect directly to the forming tool thus closing the device on the side opposite of the ignition chamber. In this way, a longer run-out section for the detonation wave could develop.

It can also be of advantage for the wave breaker to have and/or to form a curved and/or reduced passage relative to the cross section of the ignition chamber or the cross section of the support pipe. These passage shapes can take away a significant amount of energy from the reflected detonation waves.

In a particular way, at least one wave breaker element can be provided, which is arranged at least partially spaced apart from the inner walls of the ignition chamber or the inner walls of the support pipe, thus forming a passage. By using the wave breaker element for forming a passage between the inner walls of the ignition chamber or the inner walls of the support pipe, the wave breaker element can be constructed in a simple, and thus in a stable manner.

In a beneficial embodiment, a plurality of passages forming between the wave breaker elements can be provided. By using several such wave breaker elements, the effect of the reflected detonation wave on the inner walls of the ignition chamber or the inner walls of the support pipe can be diminished and distributed to several elements. Furthermore, its energy can thus be reduced step-by-step, which in turn reduces the strain on the individual wave breaker elements.

In an advantageous exemplary embodiment, the flow resistance in a flow direction away from the ignition location can be lower than toward the ignition location, due to the wave breaker. As a result, the energy of the reflected detonation wave is reduced much more substantially than it is from the original explosion triggered by the ignition mechanism, whereas the ignition mechanism is still being protected if the wave breaker is arranged between the ignition location and the forming tool.

Furthermore, as a result of the wave breaker, the flow resistance in a flow direction away from the ignition location can be greater than toward the ignition location, and the wave breaker can be mounted on the side of the forming tool facing away from the ignition location. In this way, a significant amount of energy can be extracted from the shock wave prior to being reflected at the end of the device.

In a particular way, the wave breaker can be provided with at least one throttle check element. Thus, the propagating explosion can pass the wave breaker, whereas the reflected detonation wave is decelerated before the ignition mechanism by the throttle check element.

In a special embodiment, the wave breaker can be provided with at least one one-way element. Thus, the explosion can pass the wave breaker while the reflected detonation wave can be intercepted by the one-way element prior to reaching the ignition mechanism.

Beneficially, the surface of the wave breaker can be larger than the inner surface of the ignition chamber or the inner surface of the support pipe adjacent to the wave breaker. This can result in increased friction relative to the length of the wave breaker and thus to an improved energy reduction of the reflected detonation wave.

In a particularly advantageous embodiment, the cross section of the ignition chamber and/or the cross section of the support pipe can be enlarged in the region of the wave breaker. This creates more available construction space, especially for complex wave breakers.

Advantageously, the wave breaker can have at least one lateral branch diverging from a main passage. At the branching point, the detonation wave can split, which likewise causes the energy of the detonation wave to split, and can then be reflected and absorbed a number of times in the branching region.

It is useful for the at least one branch to be ramiform, at least in part. In this way, a plurality of branching points is created where the detonation wave can separate.

It is suggested that the at least one branch can be closed at its end, thus allowing the detonation wave to remain inside the wave breaker.

According to a variation of the invention, at least one branch can form a filling channel for fluid. Thus, the fluid used in a variation of explosive forming could be funneled into the device via the wave breaker, for example. Furthermore, the explosive agent could be introduced to the inside of the device via the filling channel.

It is feasible for the spreading space in the device to be connected to a spreading volume via the branch. In this way, the detonation wave could at least partially be channeled via the wave breaker into a spreading volume to subside.

It is possible for a filling device for fluid to be arranged on the side of the forming tool facing away from the ignition location. Thus, the structure of the device on the ignition location side could be simpler and have fewer connections.

It can be beneficial for the wave breaker to have a labyrinth structure. Due to the large surface, the long labyrinth path to be passed through, and the manifold diversion of the reflected detonation wave, an effective slowing down of said detonation wave can be achieved.

In a particular way, the wave breaker can be provided with at least one labyrinth element and/or a plurality of wave breaker elements forming a labyrinth structure. Depending on the situation, it can be more beneficial to form the labyrinth from one or from several labyrinth elements, or from a plurality of elements, which together form a labyrinth structure. The first option is recommend when not much construction space is available, for example, whereas with the second option, manufacture can be easier and cheaper.

In an advantageous exemplary embodiment, the passage can be somewhat meander-shaped. The meander shape with its multiple and sharp deviations can very effectively diminish the energy of the reflected detonation front.

Advantageously, the wave breaker can be provided with at least one disc-like wave breaker element with at least one passage through the disc. The disc can offer a large impact surface by way of its front face, with low production expenditure at the same time.

It can be beneficial for the wave breaker element to be designed as a cylindrical disc. In this way, it can be of stable construction while providing a long passage for reducing the energy of the reflected detonation front at the same time.

In a particular way, a plurality of wave breaker elements having dephased consecutive passages can be provided. Thus, the detonation wave is diverted several times, thus reducing its energy in a special way.

In an advantageous embodiment, the wave breaker element can be provided with a branched passage system. Branching points in particular can reduce the energy of the reflected detonation wave substantially.

In a beneficial exemplary embodiment, the wave breaker element can be of sponge-like, mesh-like, and/or clew-like design. These design forms can effectively diminish the detonation wave and have a sufficient service life.

Advantageously, at least one wave breaker element can be designed as a deflection wall. Deflection walls are a simple way to guide and control the detonation wave.

It can be of benefit if in its progression, the deflection wall is polygonal. In this manner, an additional reduction of the energy of the reflected detonation wave is achieved.

In a particular way, a plurality of wave breaker elements piled loosely in the manner of dry bulk goods can be provided. The effect of the loosely-layered arrangement is a good weakening of the reflected detonation wave, and in a simple way, the desired effect of the wave breaker can be determined by the number and type of wave breaker elements.

In an advantageous embodiment, a plurality of wave breaker elements spaced apart from one another can be arranged consecutively in a flow direction and be staggered transversely to the flow direction. Thus, the shape of the detonation front and the wave following thereupon and their effective deceleration can be taken into consideration in a special way.

In an advantageous exemplary embodiment, at least two consecutively arranged wave breaker elements can be arranged such that they overlap. The labyrinth-like structure with constricted passages thus formed is particularly well suited to decelerate the reflected detonation wave.

In a particular way, a plurality of wave breaker elements can be supported by an wave breaker carrier. This allows for simple installation and maintenance of the wave breaker elements.

In a special embodiment, the wave breaker can contain steel and/or copper beryllium (CuBe). Due to both their robustness and hardness, these materials are particularly well suited for wave breaker application.

Advantageously, the wave breaker can at least partially be arranged to be exchangeable. Thus, material fatigue and/or material wear and tear can be anticipated in a timely manner by easily performed maintenance.

In a particular way, the supply of the explosion agent can take place on the side of the wave breaker opposite from the ignition chamber outlet. In this way, the explosion agent supply can also be protected by the wave breaker.

In an alternative beneficial exemplary embodiment, the explosion agent supply can take place between the wave breaker and the ignition chamber outlet. Thus, the ignition mechanism can be supplied with a sufficient amount of explosion agent for ignition while promoting the development and growth the explosion after the wave breaker.

BRIEF DESCRIPTION OF THE DRAWINGS

Exemplary embodiments of the invention will now be described in conjunction with the following drawings wherein like numerals represent like elements, and wherein.

DETAILED DESCRIPTION OF THE PREFERRED EMBODIMENTS

Figure 1:
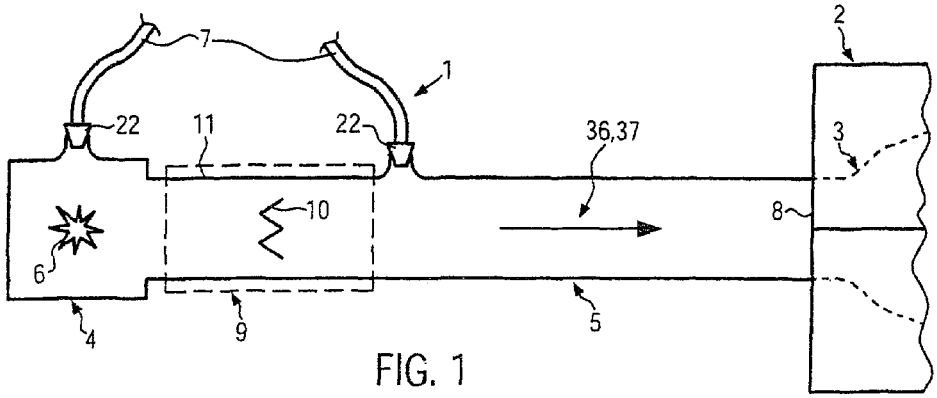
FIG. 1 is a schematic illustration of the invention.

FIG. 1 illustrates an ignition device 1 for the explosive forming of a work piece 3 inserted in a forming tool 2. The outline of the work piece 3 is thereby indicated with a dotted line, and the forming tool 2 is illustrated separated into an upper and a lower half. Ignition device 1 is comprised of an ignition mechanism 4 and an ignition chamber 5, which in this embodiment connects directly to the ignition mechanism 4 taking the form of an ignition tube. The ignition mechanism 4 has an ignition location 6, symbolically illustrated in this figure with an ignition spark, where the explosion agent is ignited. The explosion agent reaches the ignition mechanism 4 via at least one of the explosion agent feeders 7 after passing a valve 22. The explosion agent ignited in ignition location 6 expands with an explosion front into the ignition chamber 5, and the explosion front exits said ignition chamber via ignition chamber outlet 8, which is adjacent to forming tool 2, and work piece 3 embedded therein. The figure could also be interpreted such that via one of the valves 22, the device can be filled with fluid, water, for example.

Between ignition location 6 and ignition chamber outlet 8, an wave breaker 9 is provided, which in this instance is located in ignition chamber 5. The system outlines of the wave breaker 9 are thereby indicated with dashed lines, and a doubly serrated element 10 symbolizes at least one wave breaker element 10 with the indication that the flow resistance in the direction to forming tool 2 is lower than in the direction from forming tool 2. In this exemplary embodiment, the wave breaker 9 is arranged in closer proximity to ignition location 6 than to ignition chamber outlet 8 and is provided with external walls 11, which merge with those of ignition chamber 5. By way of explosion agent feeders 7, the explosion agent can be channeled directly to ignition mechanism 4, and thus to ignition location 6 and/or to ignition chamber 5 on the side opposite from wave breaker 9. Flow direction 36 is indicated by an arrow, which at the same time describes the propagation path 37 of the detonation wave. A reflected detonation wave essentially expands in the device along propagation path 37 but contrariwise to flow direction 36.

Figure 2:
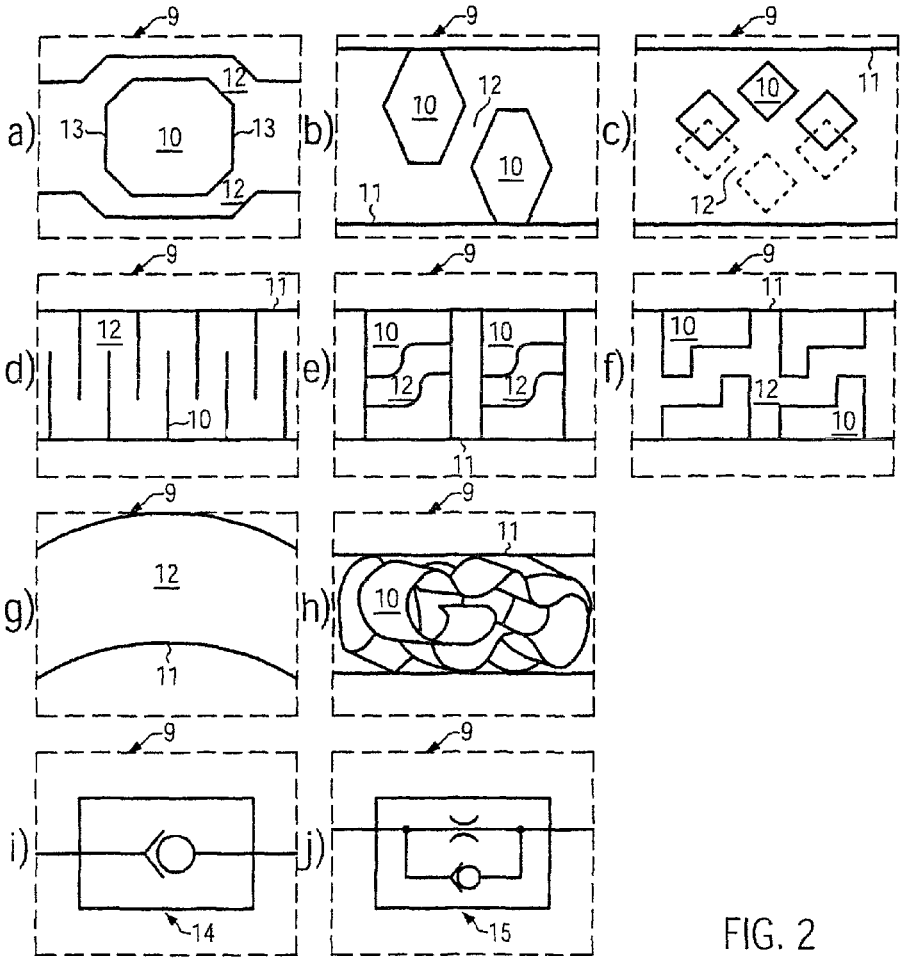
FIGS. 2*a* to 2*j* show several schematic embodiments of the wave breaker in FIG. 1 or FIG. 8.

In FIG. 2*a*, the external walls 11 of wave breaker 9 are enlarged in the region of wave breaker 9 and are adjusted to the octagonal outer contour of an wave breaker element 10. The octagonal-prismatic wave breaker element 10 and the external walls 11 in combination form both a curved and a reduced passage 12, which must be passed by the original as well as the reflected detonation wave. The front surfaces 13 of wave breaker element 10 in particular diminish the energy of the wave.

In FIG. 2*b*, two hexagonal-prismatic wave breaker elements 10 butting flatly against the external walls 11 form a curved or reduced labyrinth-like passage 12 for the detonation wave. The edges of wave breaker elements 10 being arranged consecutively in a flow direction and overlapping each other serve as wave breakers here.

In FIG. 2*c*, three wave breaker elements 10 arranged consecutively in a flow direction and staggered transversely thereto, are used. The edges of the cubiform wave breaker elements 10 are thereby oriented in flow direction 36. In a second plane parallel to the plane of projection, three additional cubiform wave breaker elements 10 are illustrated with dashes, their arrangement being offset from the one described at the start. In this way, a labyrinth-like structure with angled, reduced passages 12 is formed.

In FIG. 2*d*, walls arranged transversely to the flow direction are used as wave breaker elements 10 to force the detonation wave through a labyrinth-like, meander-like passage 12. The wave breaker elements 10 extend bordering on external walls 11 of wave breaker 9, transversely to flow direction 36, approximately vertically into the ignition chamber. FIG. 2*d* can also be interpreted such that the wave breaker elements 10 are arranged only partially tilting toward flow direction 36 of the detonation wave.

In FIG. 2*e*, two wave breaker elements 10 are arranged consecutively in flow direction 36 and gapless to the external walls 11 of wave breaker 9. Due to its curved, reduced passage 12 and the series arrangement, a labyrinth structure is formed from individual labyrinth elements.

In contrast to FIG. 2*e*, a plurality of L-shaped wave breaker elements 10 are arranged such that a labyrinth structure for an approximately Z-shaped passage 12 is formed between them in FIG. 2*f*.

In FIG. 2*g*, a basic curved passage 12 as an wave breaker is shown, the exterior walls 11 of which connect to those of ignition chamber 5.

FIG. 2*h* shows a clew-like wave breaker element 10, which causes the detonation wave to rebound manifoldly and to deflect, labyrinth-like, within itself. In part, this clew-like wave breaker element 10 abuts to the external walls 11 of wave breaker 9, in part, it is spaced apart therefrom.

Basically, FIGS. 2*a* to 2*h* can also be interpreted such that the corresponding wave breaker has surface elements arranged such that they tilt in the flow direction 36 of the detonation wave, which form the wave breaker elements 10, on which the detonation wave can reflect multiple times while being partially absorbed.

FIG. 2*i* uses the symbolism of hydraulics to illustrate a one-way element 14 as an wave breaker element 10. This is to describe an wave breaker element 10 which allows the expanding explosion wave to pass while its reflection in the opposite flow direction is blocked. It does not necessarily follow that this one-way element 14 is a valve as known from the hydraulics field.

FIG. 2*j* shows a throttle check element 15 as an wave breaker element 10. It includes a one-way element 14 like in FIG. 2*i*, and a throttle element, which is to be equated with a curved and/or reduced passage 12. As in FIG. 2*i*, only the symbolism of hydraulics is being used, and the throttle check element 15 is not necessarily a valve. The illustration is attempting to show a construction, which allows passage of the explosion in its propagation direction while hampering it in its reflection direction. Therefore, in FIGS. 2*i* and 2*j*, the respective flow resistance caused by wave breaker 9 in flow direction from ignition chamber outlet 8 to ignition location 6 is greater than it is from ignition location 6 to ignition chamber outlet 8.

Figure 3A:
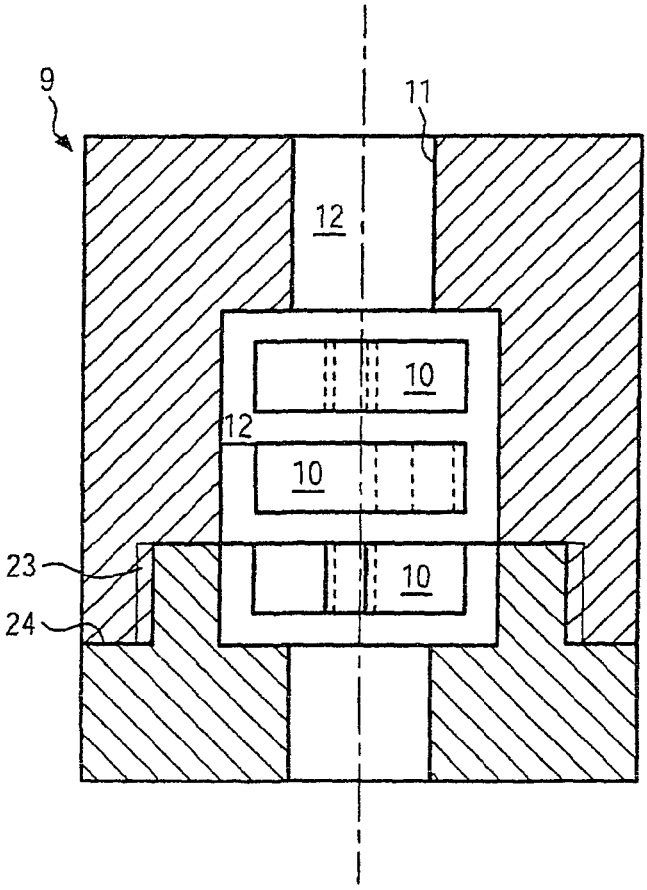
FIGS. 3*a*, 3*b* show a detailed embodiment of the wave breaker in FIG. 1 or FIG. 8.

In FIGS. 3*a* and *b*, a first detailed embodiment of an wave breaker 9 is shown, wherein three wave breaker elements 10 combined form a labyrinth structure as a multi-curved passage 12.

In FIG. 3*a*, the rotation-symmetrical wave breaker 9 is illustrated in sectional view, whereas the three wave breaker elements 10 are uncut. These are cylindrical disc-like wave breaker elements, each provided with a bore 16 and a groove 17 serving as a passage through the disc and/or past the disc. Due to the fact that relative to their bores 16 and grooves 17, the cylindrical disc-shaped wave breaker elements 10 are dephasedly arranged in the flow direction in consecutive order, the part of the detonation wave moving through wave breaker elements 10 is deflected several times. The cylindrical discs 10 are arranged spaced apart from the external walls of wave breaker 9 so that an additional passage 12 is formed at this point. By using a two-part housing structure with parting plane 24, wave breaker 9 and/or wave breaker elements 10 can be easily installed and maintained via a screw thread 23. In the region of wave breaker elements 10, the passage 12 is enlarged, thereafter once again tapered, so that the wave breaker elements 10 are unable to enter the adjacent ignition chamber 5 or support pipe 25. Furthermore, this brings about the above-mentioned reduction of passage 12.

Figure 3B:
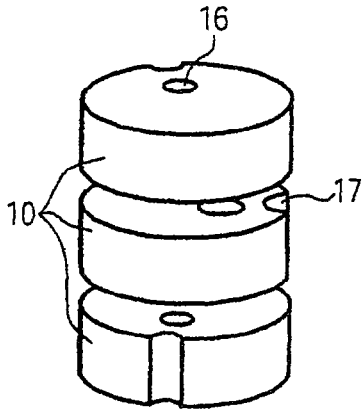
Figure 4A:
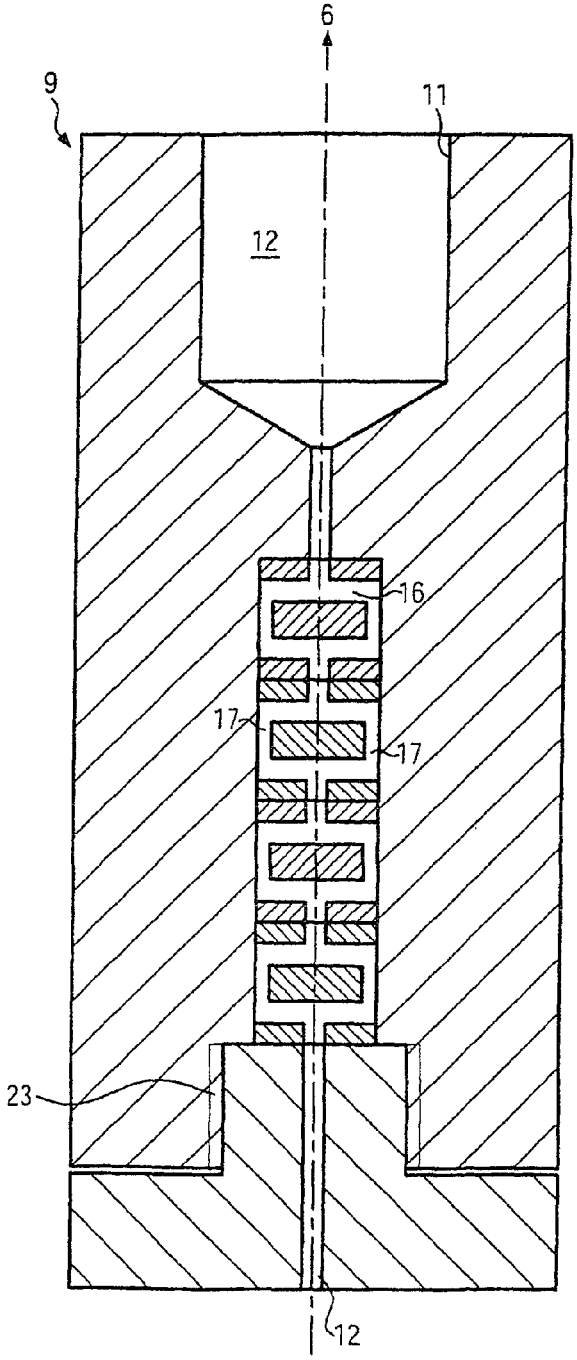
FIGS. 4*a*, 4*b* show an additional detailed embodiment of the wave breaker in FIG. 1 or FIG. 8.

In FIG. 4, a further wave breaker 9 having cylindrical disc-shaped wave breaker elements 10 is illustrated. FIG. 4*a* shows a cross-sectional view of the rotation-symmetrical wave breaker 9, wherein the wave breaker elements 10, four in all, are also cut. To make installation and maintenance easier, wave breaker 9 is once more constructed as a two-piece unit and is connected via a screw thread 23. In contrast to FIG. 3, the cylindrical disc-shaped wave breaker elements 10 are symmetrically constructed labyrinth elements. A labyrinth structure is formed by a mere stringing together in flow direction 36.

These wave breaker elements 10 are immovably abutting on the external wall 11 of wave breaker 9. Commencing at ignition location 6, a passage 12 is at the disposal of the expanding explosion wave, said passage tapering conically toward the wave breaker elements 10 and extending thereafter in its reduced form. This reduced passage 12 continues after passing wave breaker elements 10. Transversely to flow direction 36, the cylindrical disc-shaped wave breaker elements 10 are provided with two bores 16 each, which are connected to one another via laterally applied recesses 17. All longitudinal bores starting at the front surfaces 13 terminate at the bores 16. In this way, passage 12 is first branched off in T-form in order to be re-united via a second T-form. The outlet of an wave breaker element 10 abuts on the inlet of the next wave breaker element 10.

Figure 4B:
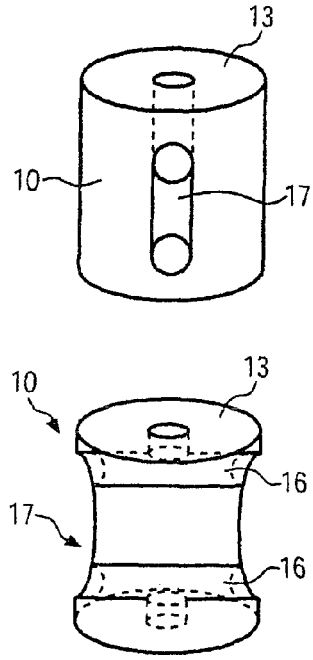

In FIG. 4*b*, two of the wave breaker elements 10 of FIG. 4*a* are illustrated from various perspectives. Due to the branched passage system, it is irrelevant how the wave breaker elements 10 are arranged consecutively in a flow direction.

Figure 5:
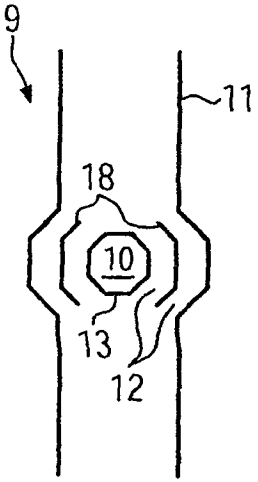
FIG. 5 shows an additional schematic embodiment of the wave breaker in FIG. 1 or FIG. 8.

In FIG. 5, the wave breaker 9 is an octagonal-prismatic wave breaker element 10, the front surfaces 13 of which are adjusted as impact surfaces in flow direction 36. Wave breaker element 13 is laterally flanked by two deflection walls 18, which continue the outer contour of wave breaker element 10 at a parallel distance thereto. Sideways of the wave breaker element 10 and deflection walls 18, the external wall 11 of wave breaker 9 is enlarged, and likewise maintains, in parallel distance to deflection walls 18, the outer contour of octagonal-prismatic wave breaker element 10. Thus, passage 12 is respectively divided between wave breaker element 10 and external walls 11, and is deflected.

Figure 6:
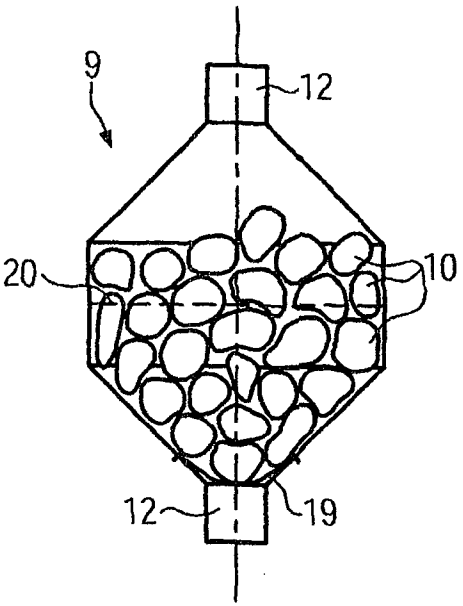
FIG. 6 shows an additional schematic embodiment of the wave breaker in FIG. 1 or FIG. 8.

In FIG. 6, passage 12 through wave breaker 9 expands in a vessel-like manner so that there is room in its expansion for a plurality of wave breaker elements 10 piled loosely in the manner of dry bulk goods. As a result of the loosely-layered arrangement of wave breaker elements 10, a plurality of ramified passages 12 through wave breaker 9 are created. Depending on the design, it can be beneficial to keep wave breaker elements 10 away from ignition location 6 and/or ignition chamber 5 with a catcher 19. This applies especially to wave breaker elements 10, which are smaller than the corresponding passage 12 and are a safeguard in the gravity direction as well as the deflecting detonation wave. Ideally, catcher 19 is of net-like design; however, it can also be provided with blocking struts, which constrict passage 12 such that no wave breaker element 10 will fit through it. In addition, catcher 19 is flow-permeable and blocks loose materials. This wave breaker 9 in particular has a substantially larger surface than the inner surface of the ignition chamber adjacent to wave breaker 9. Dashed line 20 indicates a partition possibility for installation and maintenance of the two wave breaker half-shells.

Figure 7:
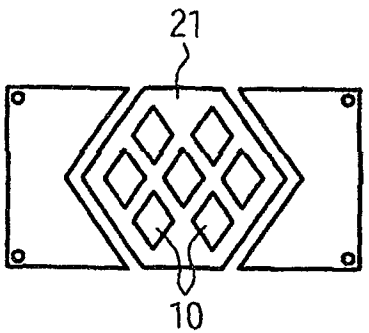
FIG. 7 shows a schematic embodiment of an wave breaker carrier for an wave breaker according to FIG. 1, 2, or 5.

In FIG. 7, a staggered arrangement of multiple, in this instance rhomboid-prismatic wave breaker elements 10 on an wave breaker carrier 21 are shown. Thus, wave breaker elements 10 can simply be exchanged. It is also possible to install a plurality of wave breaker elements 10 in wave breaker 9 via several wave breaker carriers 21 arranged consecutively or on top of each other, thus saving space.

Based on the forces in effect during deceleration of the detonation wave, wave breaker 9 and/or wave breaker elements 10 contain steel and/or copper beryllium (CuBe).

Figure 8:
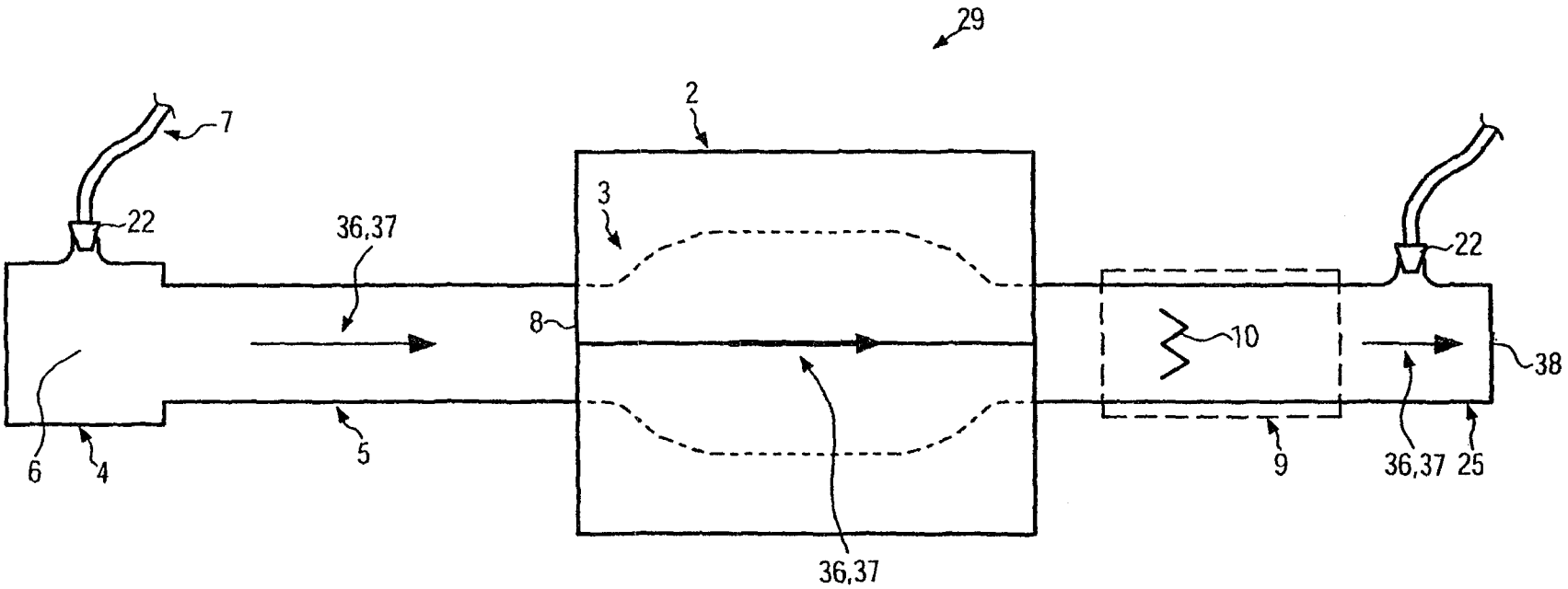
FIG. 8 shows a schematic illustration of a further embodiment of the invention.

FIG. 8 shows a schematic view of a device 29 of the invention, wherein wave breaker 9 is arranged on the side of the forming tool 2 facing away from ignition location 6. Wave breaker 9 can thereby be arranged to connect directly to forming tool 2, or at a distance thereto, or at the end of support pipe 25. Furthermore, two valves 22 are provided, wherein one is arranged at ignition location 6 and the other one at support pipe 25. For one, valves 22 can serve as explosion agent feeders 7, but can also serve as a filling device for fluid, for example, water.

Wave breaker 9 could also be arranged on the side of forming tool 2 facing ignition location 6, or else a plurality of wave breakers 9 could be provided in the propagation path of the detonation wave. Furthermore, the orientation of the symbol for wave breaker elements 10 has been turned by 180 degrees relative to the illustration in FIG. 1 to indicate that in this exemplary embodiment, the flow resistance of the wave breaker 9 in flow direction 36 is greater than it is toward ignition location 6. In this case, after passing through forming tool 2, the energy of the detonation wave can already be diminished at the end of device 29. Wave breaker 9 could be arranged in the same manner as in FIG. 1 so that at the beginning of its passage, the detonation wave is little diminished or not at all, in order to be broken after reflection by wave breaker 9 at the end 38 of device 29.

Figure 9:
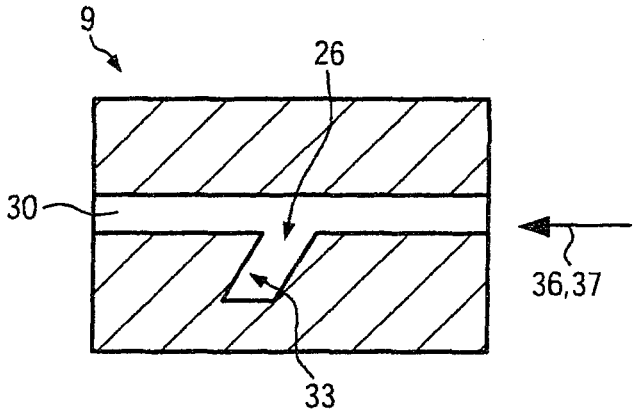
FIG. 9 is a schematic illustration of a further embodiment of the wave breaker according to FIG. 1 or FIG. 8.

FIG. 9 shows an additional embodiment of an wave breaker 9, which has a main passage 30 and a branch 26. The branch has lateral walls 33, which tilt towards the main passage. The tilt of the lateral walls 33 can be adjusted to any desired angle to the main passage 30. Only one branch 26 is shown, although a plurality of such branches at a plurality of angles to main passage 30 can be existent. At its end, branch 26 is closed. It can thus be achieved that the detonation wave remains inside wave breaker 9 and is unable to affect support pipe 25 potentially surrounding wave breaker 9, or ignition chamber 5. It can thus be accomplished that in the area of the wave breaker, at least support pipe 25 or ignition chamber 5 can be made of a material different from that of the wave breaker, which preferably is made of a robust material, as previously mentioned. In its cross section, wave breaker 9 can be circular, which makes installation inside a pipe or a pipe-shaped component easier. Any desired deviating cross section is also feasible, polygonal shapes, for example.

Figure 10:
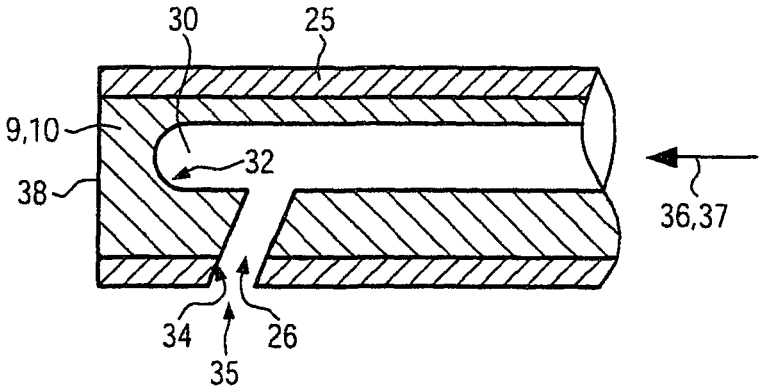
FIG. 10 is an additional schematic illustration of an embodiment of the wave breaker according to FIG. 1 or FIG. 8.

FIG. 10 shows an embodiment of wave breaker 9, which is designed as individual wave breaker element 10 and is arranged inside a support pipe 25. The wave breaker element 10 is provided with a lateral branch 26, which is open at its end and, together with a recess 34 in support pipe 25, forms a filling channel 35, through which fluid, water, for example, can be filled into the spreading space of device 29, on the one hand, or on the other hand, it can be designed to serve as explosion agent feeder 7. The spreading space extends inside the device from ignition location 6 to the end 38 of the device. In this exemplary embodiment, the cross section of wave breaker 9 is of round shape; it could, however, also be designed differently, having corners, for example.

Figure 11:
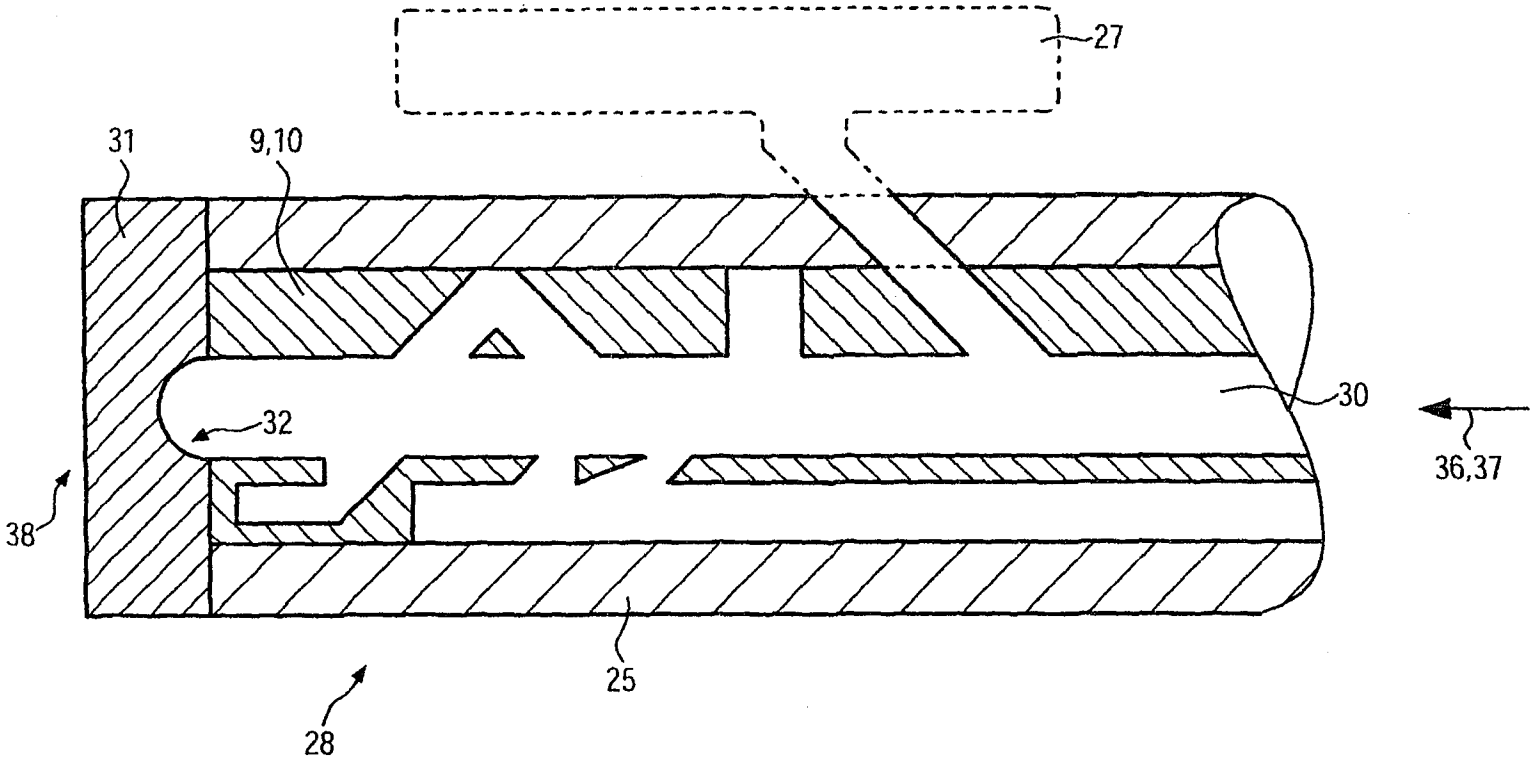
FIG. 11 is a schematic illustration of a further embodiment of the wave breaker as well as a schematic illustration of the spreading space or of a filling device.

FIG. 11 shows a further exemplary embodiment of wave breaker 9 designed as an individual wave breaker element 10, wherein wave breaker element 10 has a plurality of lateral branches, which are partially ramified and branched, as well as an exemplary branch, which is connected to spreading volume 27 via a channel 35. Here, the detonation wave can partially leave the wave breaker as well as support pipe 25, in order for its energy to be diminished in spreading volume 27. Spreading volume 27 can be filled with gas, fluid, or solid materials.

Main passage 30 terminates in a reflection surface 32, which in this exemplary embodiment is of hemispherical shape. However, reflection surface 32 can also be of a different shape, for example, calotte or pyramid-shaped, or such. In this exemplary embodiment, the reflection surface 32 is designed as part of a cover 31, which in this exemplary embodiment is removably mounted to support pipe 25 and, together with support pipe 25 and wave breaker 9, is designed as an end piece.

Figure 12:
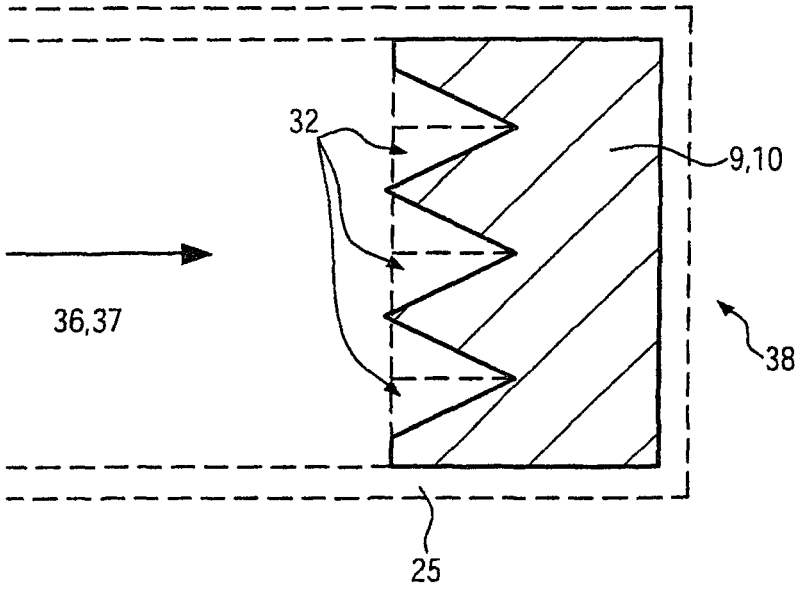
FIG. 12 is a schematic illustration of a further embodiment of the wave breaker, arranged at the end of the device according to FIG. 1 or FIG. 8.

FIG. 12 shows an additional exemplary embodiment of the wave breaker 9 of the invention, which is mounted at end 38 of device 29, and is provided with a plurality of reflection surfaces 32. In this exemplary embodiment, it is indicated that the reflection surfaces are formed such that two reflection surfaces 32 each are located opposite one another at an opening angle, and from a side view, triangular recesses are formed in wave breaker 9. This figure can also be interpreted such that it is a cross section, and as indicated by the dashed lines inside wave breaker 9, the recesses have the form of a pyramid. On reflection surfaces 32 formed as these and multiply existing on wave breaker 9, the detonation wave impacting from flow direction 36 can be broken multiple times so that the energy of the impacting detonation wave separates into a plurality of shock waves deflecting at various angles. The maximum energy left in a deflecting shock wave after reflection on wave breaker 9 can thus be reduced relative to the detonation wave.

In this exemplary embodiment, wave breaker 9 can be provided without additional support devices at the end 38 of the support pipe, said support pipe being indicated by the outer dashed lines. In the instant exemplary embodiment, a reflection of the detonation wave at the smooth end 38 of device 29 can be avoided by deploying wave breaker 9. The detonation wave can be scattered directly on wave breaker 9 by impacting the plurality of reflection surfaces 32.

FIGS. 1 to 12 and their respective characteristics can also be interpreted such that the shown features can be used in any desired combination. For this reason, the relevance of the reference numerals in the individual figures is consistent with regard to function.

What is claimed:

1. A device for explosive forming of work pieces (3) comprising an ignition chamber (5) and an ignition mechanism (4), wherein an explosive agent can be ignited in the ignition chamber (5) at an ignition location (6) using the ignition mechanism (4), whereof a detonation wave for forming the work piece can propagate, wherein a wave breaker (9) is provided in the propagation path (37) of the detonation wave and is positioned to dampen the detonation wave, wherein relative to the cross section of the ignition chamber, the wave breaker (9) comprises or forms at least one of a curved and a reduced passage (12).

2. The device according to claim 1, wherein the wave breaker (9) is arranged between the ignition location (6) and an ignition chamber outlet (8).

3. The device according to claim 2, wherein the wave breaker (9) is arranged in closer proximity to the ignition location (6) than to the ignition chamber outlet (8).

4. The device according to claim 3, wherein the wave breaker (9) is arranged directly at the ignition location (6).

5. The device according to claim 1, wherein the wave breaker (9) is arranged on the side of a forming tool (2) facing away from the ignition location (6).

6. The device according to claim 5, wherein the wave breaker (9) is arranged directly at the forming tool (2).

7. The device according to claim 5, wherein the wave breaker (9) is arranged in closer proximity to an end (38) of the device (29) located opposite the ignition location (6).

8. The device according to claim 5, wherein the wave breaker (9) forms the end (38) of the device (29) located opposite the ignition location (6).

9. The device according to claim 5, wherein the wave breaker (9) is provided inside a support pipe (25) that is positioned on the side of the forming tool facing away from the ignition location.

10. The device according to claim 5, wherein the wave breaker (9) conjointly with the support pipe (25) forms an end piece (28) that is positioned on the side of the forming tool facing away from the ignition location.

11. The device according to claim 9, wherein at least one wave breaker element (10) is provided arranged at least partially spaced apart from the inner walls of the ignition chamber or the inner walls of the support pipe thus forming a passage (12).

12. The device according to claim 1, wherein a plurality of wave breaker elements (10) is provided arranged so as to provide or form a plurality of passages (12) including said at least one of a curved and a reduced passage (12).

13. The device according to claim 1, wherein a flow resistance in a flow direction (36) through the wave breaker (9) is greater or lower away from the ignition location (6) than it is toward the ignition location (6).

14. The device according to claim 1, wherein the wave breaker (9) is provided with at least one throttle check element (15).

15. The device according to claim 1, wherein the wave breaker (9) is provided with at least one one-way element (14).

16. The device according to claim 1, wherein a surface of the wave breaker (9) is larger than an inner surface of the ignition chamber or an inner surface of the support pipe located adjacent to the wave breaker (9).

17. The device according to claim 1, wherein the wave breaker (9) comprises wave breaker elements (10) having at least some surface elements that are tilted in a flow direction (36).

18. The device according to claim 17, wherein the wave breaker elements (10) are at least partially arranged in a staggered manner.

19. The device according to claim 1, wherein at least one of the cross sections of the ignition chamber and support pipe is enlarged in the area of the wave breaker (9).

20. The device according to claim 1, wherein the wave breaker (9) has at least one lateral branch (26) separating from a main passage (30).

21. The device according to claim 20, wherein the at least one branch (26) is at least partially ramiform.

22. The device according to claim 20, wherein the branch (26) is closed at its end.

23. The device according to claim 20, wherein the at least one branch (26) forms a filling channel (35) for fluid.

24. The device according to claim 20, wherein a propagation space inside the device (29) is connected to a propagation volume (27) via the branch (26).

25. Device according to claim 1, wherein a filling channel (35) for fluid is provided on a side of the forming tool (2) facing away from the ignition location (6).

26. A device for explosive forming of work pieces (3) comprising an ignition chamber (5) and an ignition mechanism (4), wherein an explosive agent can be ignited in the ignition chamber (5) at an ignition location (6) using the ignition mechanism (4), whereof a detonation wave for forming the work piece can propagate, wherein a wave breaker (9) is provided in the propagation path (37) of the detonation wave and is positioned to dampen the detonation wave, wherein the wave breaker (9) has a system of interconnecting passages.

27. The device according to claim 26, wherein the wave breaker (9) is provided with at least one labyrinth element forming the system of interconnecting passages.

28. A device for explosive forming of work pieces (3) comprising an ignition chamber (5) and an ignition mechanism (4), wherein an explosive agent can be ignited in the ignition chamber (5) at an ignition location (6) using the ignition mechanism (4), whereof a detonation wave for forming the work piece can propagate, wherein a wave breaker (9) is provided in the propagation path (37) of the detonation wave and is positioned to dampen the detonation wave wherein the wave breaker (9) is provided with at least one wave breaker element (10) having at least one passage (12) therethrough, wherein the wave breaker element (10) is a cylindrical disc.

29. The device according to claim 28, wherein a plurality of wave breaker elements (10) having dephased consecutive passages (12) is provided.

30. The device according to claim 28, wherein the wave breaker element (10) has a ramiform passage system.

31. The device according to claim 1, wherein the wave breaker element (10) is of sponge-like, mesh-like, and/or clew-like design.

32. The device according to claim 1, wherein at least one wave breaker element (10) is a deflection wall (18).

33. The device according to claim 32, wherein the deflection wall (18) is polygonal in its progression.

34. The device according to claim 12, wherein a plurality of wave breaker elements (10) is provided piled loosely in the manner of dry bulk goods.

35. The device according to claim 1, wherein a plurality of wave breaker elements (10), which are spaced apart from one another, are arranged consecutively in a flow direction (36) and are staggered transversely to the flow direction (36).

36. The device according to claim 1, wherein a plurality of wave breaker elements (10), which are spaced apart from one another, are arranged consecutively in a flow direction (36) and are staggered transversely to the flow direction (36), and wherein at least two consecutively arranged wave breaker elements (10) are arranged such that the two consecutively arranged wave breaker elements overlap one another.

37. The device according to claim 1, wherein a plurality of wave breaker elements (10) are supported by an wave breaker carrier (21).

38. The device according to claim 1, wherein the wave breaker (9) comprises at least one of steel and copper beryllium (CuBe).

39. The device according to claim 1, wherein the wave breaker (9) is arranged such that it is at least partially exchangeable.

40. The device according to claim 2, wherein a supply of an explosive agent (7) takes place on the side of the wave breaker (9) located opposite the ignition chamber outlet (8).

41. The device according to claim 2, wherein a supply of an explosive agent (7) takes place between the wave breaker (9) and the ignition chamber outlet (8).

42. The device according to claim 1, wherein the wave breaker (9) is arranged outside of where a forming tool is configured for holding the work piece.

43. The device according to claim 10, wherein at least one wave breaker element (10) is provided arranged at least partially spaced apart from the inner walls of the ignition chamber or the inner walls of the support pipe thus forming a passage (12).

* * * * *